United States Patent [19]

Tengler

[11] 4,420,215

[45] Dec. 13, 1983

[54] VARIABLE EFFECTIVE LENGTH CANTILEVER CONTACT AND CONNECTOR

[75] Inventor: John N. Tengler, Chardon, Ohio

[73] Assignee: A P Products Incorporated, Mentor, Ohio

[21] Appl. No.: 107,352

[22] Filed: Dec. 26, 1979

[51] Int. Cl.[3] ..... H01R 13/50

[52] U.S. Cl. ..... 339/176 R; 339/176 M; 339/276 SF

[58] Field of Search ..... 339/176 R, 176 M, 176 MF, 339/176 MP, 276 SF

[56] References Cited

U.S. PATENT DOCUMENTS 3,289,148 11/1966 Antes ..... 339/176 MP
3,902,776 9/1975 Williams et al. ..... 339/276 SF X
4,052,117 10/1977 Tengler et al. ..... 339/17 CF

FOREIGN PATENT DOCUMENTS 1050131 3/1979 Canada ..... 339/176 M
608333 9/1960 Italy ..... 339/176 MP

*Primary Examiner*—Joseph H. McGlynn
*Assistant Examiner*—Frank H. McKenzie, Jr.
*Attorney, Agent, or Firm*—Maky, Renner, Otto & Boisselle

[57] ABSTRACT

An electrical contact includes a contacting means for electrically connecting with a member inserted to engagement therewith and a support means for supporting the contacting means in position for such engagement. The support means includes at least one cantilever arm having an effective length that varies during deformation thereof in response to a member inserted to engagement with the contacting means. Moreover, the contact is positioned in a cell-like containment portion of a relatively fixed housing having a wall against which the cantilever-like portion may be supported at various locations along the length thereof. The combination may be employed as an electrical breadboard to facilitate making electrical connections.

31 Claims, 8 Drawing Figures

VARIABLE EFFECTIVE LENGTH CANTILEVER CONTACT AND CONNECTOR

TECHNICAL FIELD

The present invention relates generally to electrical contacts and, more particularly, to those of the cantilever type. Moreover, the invention relates to an electrical connector using such contacts and, more particularly, to such a connector used as an electrical breadboard type device.

BACKGROUND OF PRIOR ART

Typical prior art cantilever contacts are of the type having a support arm or beam that is relatively fixed at one end and otherwise is relatively free to bend as a member, such as a male pin contact, electrical lead, or the like, is inserted to engagement with a contacting surface usually proximate the opposite end of the support arm, i.e. opposite the relatively fixed end thereof. There are a number of disadvantages inherent in the prior art cantilever contacts. For example, such a cantilever contact may be too easily overstressed causing a permanent deformation therein and, thus, a reduced or eliminated effectiveness for future electrical contacting purposes. Also, the force resisting insertion of a member to engagement with such contacting surface may vary extremely widely in dependence on the amount of bending of the cantilever arm.

There is, of course, a wide variety of electrical connectors using electrical contacts therein to effect electrical and mechanical connection with members inserted to engagement therewith. Typically, such a connector includes a relatively fixed electrically non-conductive housing for supporting one or more contacts therein. The housing usually has one or more access ways for guiding other members, such as pin contacts, electrical leads, etc, intended to be inserted into the housing, to good electrical and mechanical connection with the contacts therein. One such connector is designated a breadboard, which is an apparatus having multiple sets of contacts for connection with various members inserted to engagement therewith, with each such set being connected in electrical parallel, whereby two members inserted to engagement with respective contacts of one set will become electrically connected via such contacts. Usually each such contact is contained in a discrete cell-like volume or containment area in the body of the housing for electrical isolation purposes.

In accordance with the best mode and preferred embodiment of the present invention, the features thereof will be described hereinafter with respect to such an electrical breadboard. However, it will be appreciated that the various features of the invention may be employed with other types of electrical connectors.

One type of electrical contact frequently use in electrical breadboards has been the fork contact. A typical fork contact has a pair of arms or tines extending parallel to each other and outwardly from a common electrically conductive base. An advantage to such fork contacts is the effective wiping action of the contacting surfaces associated with both tines against an inserted member and other advantages are the balancing and thus halving of forces effectively deforming the tines as a member is inserted and the self-centering of the inserted member between the tines. However, such fork contacts usually must be formed of a relatively high quality and, thus expensive, metal or alloy for good contactability and resiliency characteristics. A particular disadvantage of a fork contact vis-a-vis a single arm cantilever contact is that the former usually requires up to twice the amount of material compared to that needed for about the same size cantilever type contact.

SUMMARY OF THE INVENTION

In accordance with one aspect of the present invention an electrical contact has contacting means for electrically connecting with a member inserted to engagement therewith and support means for supporting the contacting means in position for such engagement, the support means including at least one cantilever-like portion having an effective length that varied during deformation thereof. In accordance with another aspect of the invention an electrical contact has a variable effective length cantilever-like support means and a contacting means supported by the support means for electrically connecting with a member inserted to engagement therewith.

In accordance with still another aspect of the invention an electrical connector has an electrically non-conductive support and an electrical contact, which includes a contacting means for electrically connecting with a member inserted to engagement therewith and a support means for supporting the contacting means in position for such engagement, the support means including at least one resilient deformable cantilver-like portion. Moreover, such electrical connector includes a mounting means for mounting the contact relative to the support to enable the latter to support the cantilever-like portion at varying locations along its length in dependence on the amount of deformation thereof, whereby in cooperation with the support the cantilever-like portion has a variable effective length.

In accordance with a further aspect of the invention an electrical breadboard kit inclused an electrically non-conductive housing having a plurality of discrete containment volumes therein for respectively containing electrical contacts in the same, a means for providing access into the containment volumes through at least one side of the housing to permit insertion of a member to engage a respective electrical contact therein, and at least one set of electrical contacts insertable into the containment volumes in a preferred directional orientation, the housing and contacts including cooperable means for facilitating proper insertion of the contacts into the containment volumes in such preferred directional orientation.

Other features and aspects of the invention will become more apparent for the following description.

With the foregoing in mind, a principal object of the invention is to provide an effective, relatively inexpensive electrical contact as well as a connector employing the same, such connector preferably being in the form of an electrical breadboard.

Another object is to facilitate the making of an electrical breadboard that can be sold in a disassembled kit form.

An additional object is to linearize the amount of force required to deflect an electrical contact, especially of the cantilever type.

A further object is to obtain maximum use of the properties of materials used in an electrical contact.

Still another object is to prevent overstressing of an electrical contact.

Still an additional object is to facilitate proper insertion of an electrical contact into a connector housing.

Still a further object is to provide good conductivity, contactability, and material formation facility and resiliency properties in a relatively low cost electrical contact.

DESCRIPTION OF THE PREFERRED EMBODIMENT

Figure 3:
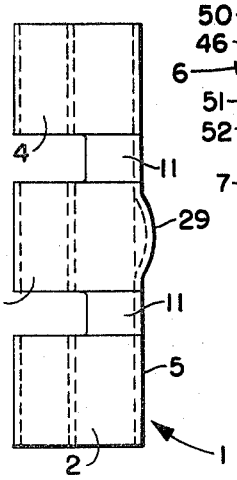
FIG. 3 is a top view of the set of electrical contacts of FIG. 1.
Figure 2:
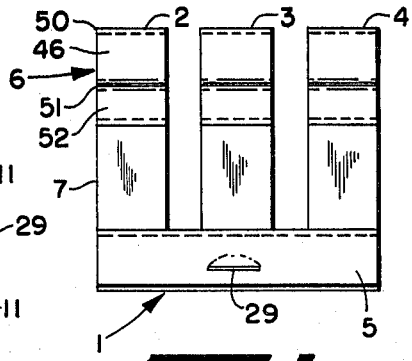
FIG. 2 is a front elevational view looking generally in the direction of the arrows 2—2 of FIG. 1.

Referring now in detail to the drawing, wherein like reference numerals designate like parts in the several figures, and initially to FIGS. 1-4, a set 1 of electrical contacts 2, 3, 4 is illustrated. The contacts 2-4 preferably are identical, are formed of electrically conducting material, such as alloy No. 688 of Olin Company, perferably have good electrical conductivity and contactability characteristics, preferably are relatively easily formed to the illustrated configuration, and preferably are electrically and mechanically connected by a tap or strip 5.

As is shown in the drawing, each contact is of the single-sided or cantilever type, as opposed to the conventional fork-type of contact, although, if desired, the features of the present invention may be applied to fork contacts as well.

Fundamentally, each contact, such as the contact 2, has a contacting portion 6 intended to provide wiping engagement with an electrically conductive member inserted with a sliding action thereacross and a support portion 7 for supporting the contacting portion. The support portion 7 is of the cantilever type in that it provides a cantilever type action as the contact 2 is deformed in response to the insertion of a member in engagement with the contacting portion 6, as will be described in greater detail below.

Figure 1:
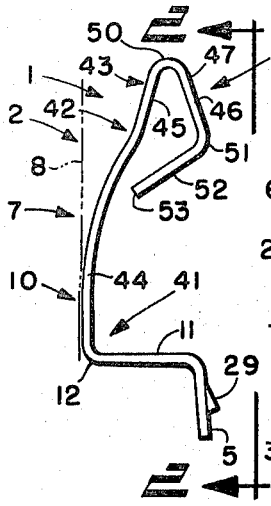
FIG. 1 is a side elevation view of a set of electrical contacts in accordance with the present invention.
Figure 6:
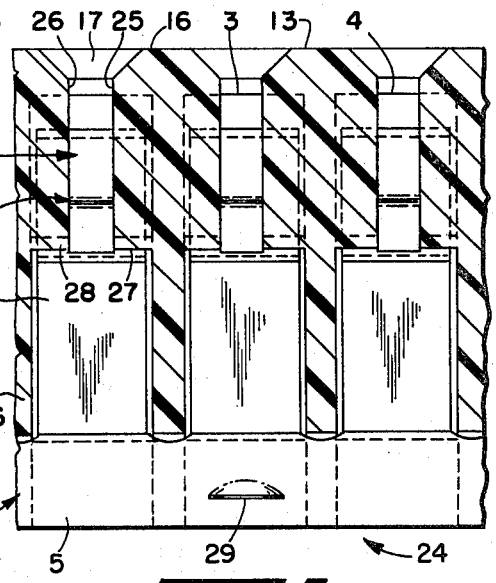
FIG. 6 is a section view looking generally in the direction of the arrows 6—6 of FIG. 5.

To provide the desired cantilever type action for the contact 2, one end of the support portion 7 preferably is mounted on or supported by a relatively fixed support, such as a wall 8 illustrated in phantom in FIG. 1. Thus, for purposes of the following description, it will be assumed that the illustrated lower part 10 of the support portion 7 is held in relatively fixed position with respect to the wall 8 in a manner to be described in greater detail below. A seat-like portion 11, which extends in a direction approximately normal to the major directional extent of the support portion 7 extends from a junction 12 with the latter to the strip 5 which also extends in a generally normal direction to that of the seat-like portion 11.

Turning briefly to FIGS. 5-8, an electrical connector preferably in the form of an electrical breadboard type device 13 using multiple sets 1 of electrical contacts is shown. Although the features of the connector 13 will be described in detail below with particular reference to inclusion in an electrical breadboard type device, it will be appreciated that those features may be employed in accordance with the invention in other types of electrical connector devices.

Fundamentally, the connector 13 includes an electrically non-conductive housing 14 with walls that form or define a plurality of containment volumes 15 for containing respective electrical contacts in the housing. The housing 14 has a top wall 16 with plural openings 17 providing access to the containment volumes 15. In particular, a member, such as an electrically conductive pin or lead 18 may be inserted through an opening 17 to engage a contacting portion 6 of an electrical contact 2, for example, in a containment volume 15.

Figure 7:
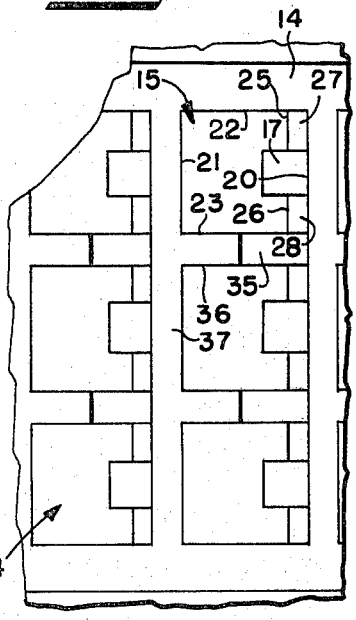
FIG. 7 is a bottom plan view of the connector of FIG. 5 with the contacts removed therefrom.
Figure 4:
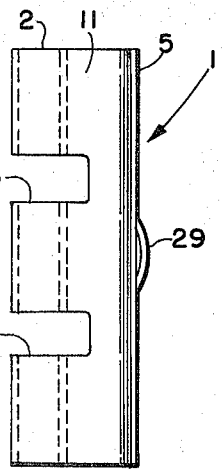
FIG. 4 is a bottom view of the set of electrical contacts of FIG. 1.
Figure 8:
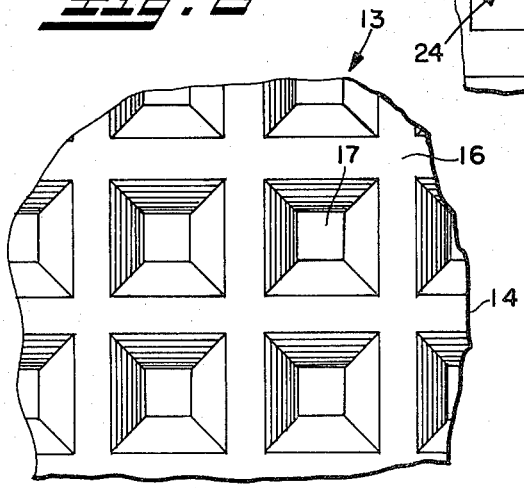
FIG. 8 is a top view of the electrical connector of FIG. 5.

As is seen in FIG. 7, each containment volume 15 is formed by front and back walls 20, 21 and a pair of side walls 22, 23. Preferably the containment volumes 15 are open at the bottom 24 of the housing 14. The front and back walls 20, 21 cooperate with the contact set connecting strip 5, the contact seat-like portions 11, and the lower part 10 of contact support portions 7 effectively resiliently to wedge or to hold the respective contacts in the positions shown, for example, in FIGS. 5 and 6. For that purpose, the strip 5 preferably would ordinarily take an unrestricted directional extent relative to the seat-like portions 11 to define an obtuse included angle therebetween. Therefore, upon insertion of a contact 2 into a containment volume 15, the strip 5 will be slightly resiliently deformed by the front wall 20 thus effectively forcing the lower support portion part 10 to a relatively fixedly mounted position with respect to the back wall 21. Moreover, a pair of preload bars 25, 26 are positioned at the illustrated upper portion of the front wall 20 on opposite sides of the opening 17 to apply a preload force against the contacting portion 6 to urge the same and the contact support portion 7 toward the back wall 21, thus further asisting to hold the contact securely in the containment volume 15. Being located on opposite sides of the opening 17, the preload bars 25, 26 provide a channel therebetween for guiding a pin 18 into clearly accessible engagement with the contacting portion 6. Preferably the illustrated lower ends 27 and 28 of the contacting bars 25, 26 are tapered to facilitate inserting the contacts from the bottom 24 of the housing 14 into the respective containment volumes 15 without damaging the contacting portions 6. The angular offset of the strip 5 from a true parallel relation to the lower part 10 of the support portion 7 or normal to the seat-like portion 11 enables a relatively large tolerance in the spacing between the front and back walls 20, 21 also assuring satisfactory retention of the contacts in the respective containment volumes 15. If desired, a barb-like protrusion 29 may be stamped or otherwise formed in the strip 5 to bite into the material of the housing front wall 20 further to secure the respective contacts of the associated set in the housing 14 as shown.

Figure 5:
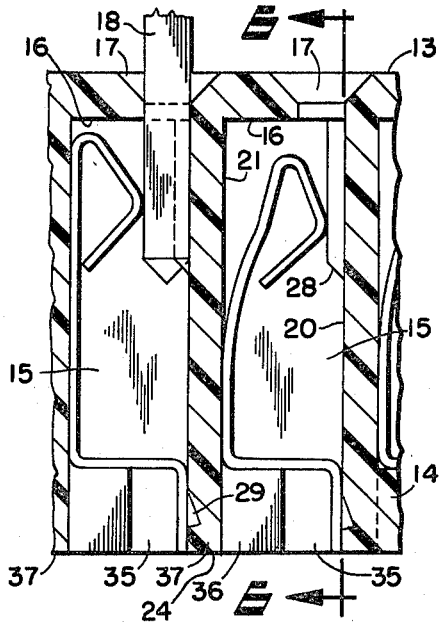
FIG. 5 is a section view of an electrical connector, such as an electrical breadboard, in accordance with the present invention, one containment volume showing a single contact therein and the other containment volume showing a member inserted into engagement with an electrical contact therein.

The contacts 2, 3, 4 should be inserted into the respective containment volumes 15 in the preferred directional orientation illustrated in the figures with the respective contacting portions 6 properly aligned to engage members 18 inserted through openings 17 and with the contacting portion ordinarily being engaged, as shown in FIG. 5, with the preload bars 25, 26 when no member has been inserted. To facilitate inserting each contact set 1 in the correct directional orientation, cut-outs 35 of limited extent are formed in the rib-like housing walls 36, the surfaces of which form the side walls 22, 23 of respective adjacent containment volumes 15, to receive the illustrated downwardly extending strip 5 as is seen most clearly in FIGS. 5–7. Preferably there are no cut-outs formed in the rib-like housing walls 37, the surfaces of which form the front and back walls 20, 21 of respective containment volumes 15, thus making it difficult and usually impossible to insert a contact set into respective containment volumes that are in the wrong orthogonal direction. Moreover, the arrangement of fully extending rib-like walls 36 and cut-outs 35 therein proximate the containment volume front walls 20 prevents full insertion of a contact set in the correct containment volumes 15 but in the incorrect directional orientation, i.e. with the contacting portion 6 facing the wrong direction so as to prevent insertion of a member 18 into proper engagement therewith.

The housing 14 preferably is formed of plastic, plastic-like, or like electrically non-conductive material, with the preferred material being that sold under the trademark CELCON of The Celanese Corporation. The housing 14 may be injection molded as a single piece and in the case of its form as an electrical breadboard may have, for example, 78 containment volumes 15 arranged in 26 rows with three containment volumes per row to accept contact sets 1 having three contacts in each set. Thus, for example, the contacts 2, 4 at ends of a set may connect two electronic components, electrical elements, such as resistors, capacitors, etc., and the middle contact 3 may provide for signal injecting or testing purposes or may provide a connection to a still further electronically electrical element.

Preferably each contact set 1 has plural contacts not only to provide electrical connections therebetween but also to facilitate manual manipulation thereof. With such facility and the directional guidance provided by the rib-like walls 36, 37 and cut-outs 35, the contact sets may be inserted into respective containment volumes with extreme facility. Therefore, if desired, the electrical breadboard 13 may be manufactured, packaged and sold in kit form with the contact sets 1 now yet inserted in the housing 14. With a manufacturing step eliminated, then, the total cost of such a kit, which may be easily assembled by a purchaser, can be minimized.

Referring back to FIG. 1, it will be appreciated that the wall 8 is analogous to the back walls 21 of respective containment volumes 15. It is the purpose of such wall 8 to provide a relatively fixed support for the support portion 7 of the contact 2 as the latter undergoes cantilever-like deformation of deflection. Examining the contact 2 in detail, it will be seen that the support portion 7 preferably has three parts 41, 42, 43. The lowermost part 41 extends upwardly from the junction 12 and the part 10 which is in direct relatively fixed engagement with the wall 8. In the preferred embodiment and best mode, the lowermost part 41 when in its free state, i.e. without any preload force having been applied to the contacting portion 6 by the preload bars 25, 26, such portion is a curved spring 44 of constant radius. The intermediate part 42 may be considered a dimple, a reverse bend relative to the curvature of the springs 44, or simply a discontinuity leading away from the circumference direction thereof toward the uppermost part 43. The uppermost part 43 preferably is a straight extent 45 of the contact material, although, if desired, such part may be concavely curved in the same direction as the spring 44.

The contacting portion 6 also preferably includes a linear extent 46 having a surface 47 intended for sliding engagement with a member 18 as the latter is slid downwardly into a containment volume 15, generally to the position shown in FIG. 5. A resilient, curved, hairpin-like coupling 50 resiliently connects the contacting portion extent 46 with the uppermost part 43 of the arm-like support portion 7. The coupling 50 provides a resilient pivot area to permit relative movement of the contacting portion 6 with respect to the support portion 7 and particularly the uppermost part 43 thereof. Preferably the most remote tip area 51 of the contacting portion 6, i.e. remote from the wall 8, is the area of the contacting portion that ultimately directly engages the member 18, as is illustrated in FIG. 5. Ordinarily, with the contact 2 inserted in the containment volume 15 (FIG. 5) without a member 18 inserted therein, the tip 51 engages the preload bars 25, 26. The depth of the preload bars, the spring force constant of the coupling 50, the angular relation between the contacting portion extent 46 and the support portion extent 45, and the length of the contacting portion extent 46, as well as other parameters of the contact 2, are all so interrelated such that the apex of the coupling 50 ordinarily will be spaced sufficiently out of direct alignment with the housing opening 17. Such position orientation assures that a member 18 may be freely inserted into the opening 17 and into sliding engagement with the contacting portion 6 without encountering an impediment of the coupling 50.

A stop extension 52 of the contact 2 extends from the tip 51 of the contacting portion 6 in a direction pointing back toward the arm-like support portion 7. It is the purpose of the stop extension 52 to have its tip 53 directly abut or engage the support portion 7 when the latter over its entire length between junction 12 and coupling 50 is substantially completely engaged with the wall 8. Upon such occurrence, which ordinarily would be caused by the insertion of a member 18 of maximum size intended for use in the connector 13, the stop extension 52 will cause the contacting portion 6 to stop further deflection unless extremely excessive force is applied thereby to prevent overstressing of the contact and possible destruction thereof by a too large inserted member. Accordingly, with the support portion 7 bottomed out against the wall 8 and the stop extension tip 53 engaged with the support portion 7, the contacting portion extent 46 ordinarily will prevent full insertion of too large a member 18.

In operation of the contact 2, then, in response to the insertion of a member 18 into sliding engagement therewith, a force is applied to the surface 47 by the member as it slides down the same urging the contact toward the wall 8. Such force tends to create a moment in that part of the support portion 7 directly engaged with the wall 8, say initially by the lower part 10 and junction 12, and such support portion parts, as well as the seat-like portion 11 and the front wall 20 of the containment volume 15 (FIG. 5) cooperate to oppose such moment. As a result, the lower part 41 of the support portion 7 will bend, bringing more and more of the same, starting with the lowermost part thereof and moving toward the intermediate part thereof, into supportive engagement with the wall 8 (the back wall 21 in FIG. 5). What is believed to happen, in effect, is that the illustrated lowermost incremental portion of the support portion 7 will reach its yield load at which time it becomes engaged with the wall 8, causing the effective fulcrum, support point, "prop point" at which the unengaged part (unengaged with the wall 8) and the engaged part join to move dynamically or substantially continuously, as opposed to step-wise up the wall 8; further force applied to the contacting portion 6, and accordingly bending of the support portion 7 will bring the next higher incremental area of the support portion 7 to its yield point and into engagement with the wall 8, further raising the effective fulcrum point. During such deformation a certain amount of deformation may also occur at the resilient coupling area 50 and some deformation may occur at the uppermost part 43 of the support portion 7. It is the purpose of the discontinuity middle part of 42 of the support portion 7 to cause a controlled bending of the total cantilever arm of support portion 7 to bend substantially linearly and to become fully supported by the wall 8 at the time or point that the tip 53 of the stop extension 52 becomes engaged with the forward surface of the support portion 7.

It has been found that the contact 2 in use as described above when analyzed using a free body diagram analysis acts quite similarly to a cantilever beam with a force applied at one end. In fact, it has been found that there is a substantially linear correlation between the normal force exerted by the contacting portion tip 51 on a member 18 and the displacement of the tip 51.

In view of the foregoing, it will be appreciated that the invention provides an improved contact and connector using the same. In the preferred embodiment and best mode of the invention the opening 17 out of offset in the top wall 16 of the housing 14 and are spaced relative to each other on 0.100" centers. The number of contacts in any set may be increased or decreased from the three shown in the preferred embodiment and the size of the housing may be increased or decreased, as desired.

I claim:

1. An electrical contact, comprising contacting means for electrically connecting with a member inserted to engagement therewith, and support means for supporting said contacting means in position for such engagement, said support means including at least one cantilever-like portion having an effective length that varies substantially continuously over at least a portion thereof during deformation thereof.

2. An electrical contact, comprising contacting means for electrically connecting with a member inserted to engagement therewith, and a variable effective length cantilever-like support means for supporting said contacting means as the effective length of said support means varies substantially continuously over at least a portion thereof during a prescribed amount of deformation thereof.

3. The contact of claims 1 or 2, said support means comprising a spring of substantially constant radius.

4. The contact of claims 1 or 2, said support means comprising an arm-like support, at least one portion being mountable in a relatively fixed operative position and at least another portion being deformable during operative usuage thereof and, thus, movable relative to said one portion.

5. The contact of claim 4, said other portion comprising a curved arm deformable in response to force applied at least proximate one end, said one portion being at least proximate the other end of said curved arm.

6. The contact of claim 5, said curved arm comprising a first length curved in a first direction commencing at least proximate said one portion, and a second length at the end of said first length removed from said one portion, and a juncture between said first and second lengths having the effect of a reverse direction bend relative to such first direction of curvature of said first length.

7. The contact of claim 6, said contacting means comprising a first surface positionable to facilitate sliding engagement with such a member and further comprising means for coupling said contacting means to said support means relatively remotely of said one portion of said support means .

8. The contact of claim 7, said coupling means comprising a resilient hairpin-like curved integral extension of said support means and contacting means.

9. The contact of claim 8, said support means being deformable into engagement with a relatively fixed support surface in amounts that vary in dependence on a dimensional parameter of such member inserted to engagement with said contacting means, said coupling means being formed to hold said first surface at a relatively acute angle relationship with respect to the portion of said support means proximate said coupling means, and said contacting means including a further length remote from said coupling means extending generally toward said support means to engage the same when substantially fully engaged with such support surface.

10. The contact of claim 4, further comprising means for connecting a plurality of such contacts in electrical parallel and for mechanically connecting a plurality of such contact means and respective support means thereof in at least approximately parallel position relation.

11. The contact of claim 4, said one portion comprising a first extent positioned in approximately the same general directional extent as said another portion and a seat-like extent extending generally in a direction approximately normal relative to that of said first extent, to hold the contact in a support housing.

12. The contact of claim 11, and further comprising in combination therewith a support housing for receiving said contact to position the same in readiness to effect an electrical connection between said contacting means and a member inserted into said support housing to engagement with said contacting means.

13. The contact of claims 1 or 2, said support means comprising a resilient cantilever support deformable to engage progressively along its length with a relatively fixed support, and mounting means for mounting one end of said resilient cantilever support in fixed relation with respect to such relatively fixed support, and further comprising coupling means for coupling said contacting means to said support means at least proximate an end thereof relatively remote from said mounting means, and said contacting means comprising a contacting surface for slidingly engaging a member upon insertion of the latter to engage the former, and said contacting surface being positioned to have a length portion thereof pointing toward said mounting means.

14. The contact of claim 13, said coupling means comprising a resilient hairpin-like curved integral extension of said support means and said contacting means for normally holding said support means and said contacting surface in relation to define an included acute angle therebetween whereby upon application of force to said contacting means by a member inserted to engage the same, said coupling means transfers force to said support means causing cantilever-like deflection thereof toward such relatively fixed support, causing a change in the effective location of the fulcrum point of the latter with respect to said cantilever support, and thus a change in the effective cantilever length of said cantilever support.

15. The contact of claim 14, said coupling means also being capable of deflection in response to application of force to said contacting surface by such member, and said contacting means further comprising stop means engageable with said support means for limiting the amount of normal deflection of said coupling means and, thus, the amount of normal travel of said contacting surface.

16. The contact of claims 15, said contacting means and support means being cooperatively inter-related and operative in response to force applied thereto by such a member to cause said stop means to move to engage said support means approximately simultaneously with the deflection of said cantilever support to a position substantially fully engaged with such relatively fixed support.

17. An electrical connector, comprising an electrically non-conductive support, an electrical contact, said electrical contact including contacting means for electrically connecting with a member inserted to engagement therewith, and support means for supporting said contacting means in position for such engagement, said support means including at least one resiliently deformable cantilever-like portion and mounting means for mounting said contact relative to said support to enable the latter to support the cantilever-like portion at substantially continuously varying locations along its length in dependence on the amount of deformation thereof, whereby in cooperation with said support, said cantilever-like portion has a substantially continuous variable effective length over at least a portion thereof.

18. The connector of claim 17, further comprising housing means for containing said contact, said support comprising a wall of said housing means, and said housing means having additional walls and an opening in at least one of said walls for guiding a member inserted therein to engagement with said contacting means.

19. The connector of claim 18, wherein said connector has plural contacts and said housing walls cooperate to form plural containment volumes for containing respective contacts, and further comprising means for electrically and mechanically connecting a plurality of said contacts, said contacts having a preferred directional orientation in said respective containment volumes, and said contacts and housing means having cooperable means for facilitating proper insertion of said contacts into said containment volumes in such preferred directional orientation.

20. The connector of claim 19, at least some of said walls comprising rib-like walls, at least some of said rib-like walls having a shorter dimension than at least some of the other rib-like walls, to define a cut-out area, and said cooperable means comprising a cooperative portion of said means for connecting positionable in said respective cut-out areas.

21. The connector of claim 19, further comprising pre-load means in said containment volumes for applying a pre-load force to said contact to help to hold the contact in said housing means in aligned position to engage an inserted member by said contacting surface.

22. The connector of claim 19, further comprising locking means for locking said contacts in said housing means.

23. The connector of claim 17, said support and said support means being cooperative whereby the former supports the latter during deformation of the latter in such manner as to permit the material of said support means at each respective location therealong to reach its yield point, whereupon the same abuts said support causing a dynamic displacement of the effective point of support of said support means by said support, and thus a dynamic change in the effective length of the latter.

24. An electrical breadboard kit comprising an integral electrically non-conductive housing having a plurality of discreet containment volumes therein for respectively containing electrical contacts therein, means for providing access into said containment volumes through at least one side of said housing to permit insertion of a member to engage a respective electrical contact, and at least one set of electrical contacts insertable into said containment volumes in a preferred directional orientation, said housing and contacts including cooperable means for facilitating proper insertion of said contacts into said containment volumes in such preferred directional orientation, and wherein each contact comprises contacting means for electrically connecting with a member inserted to engagement therewith and a variable effective length cantilever-like support means for supporting said contacting means as the effective length of said support means varies substantially continuously over at least a portion thereof during a prescribed amount of deformation thereof.

25. The kit of claim 24, said contacts comprising means for electrically and mechanically connecting plural electrical contacts to form such a set thereof.

26. The kit of claim 25, said means for connecting comprising a strip of material integral with respective contacts of the set, and said cooperable means comprising opening means in said housing for receiving at least part of said strip.

27. The kit of claim 26, said housing having rib-like walls for forming at least some of said containment volumes, and said contact sets comprising a plurality of the same, said opening means comprising opening means in those rib-like walls parallel to contacts of a single respective set.

28. The contact of claim 1, wherein said cantilever-like portion has an effective length that decreases substantially continuously during deformation thereof by insertion of such member into engagement therewith.

29. The contact of claim 2, wherein said cantilever-like support means has an effective length that decreases substantially continuously during deformation thereof by insertion of such member into engagement therewith.

30. The connector of claim 18, wherein said housing means comprises an integral housing.

31. The connector of claim 19, said support and said support means being cooperative whereby the former supports the latter during deformation of the latter in such manner as to permit the material of said support means at each respective location therealong to reach its yield point, whereupon the same abuts said support causing a dynamic displacement of the effective point of support of said support means by said support, and thus a dynamic change in the effective length of the latter.

* * * * *